US010479579B2

(12) United States Patent
Pendergraph

(10) Patent No.: US 10,479,579 B2
(45) Date of Patent: Nov. 19, 2019

(54) PACKAGING SYSTEM AND MANUFACTURING THEREOF

(71) Applicants: Robert Bosch Tool Corporation, Broadview, IL (US); Robert Bosch GmbH, Stuttgart (DE)

(72) Inventor: Melvin A. Pendergraph, Arlington Heights, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 730 days.

(21) Appl. No.: 13/833,409

(22) Filed: Mar. 15, 2013

(65) Prior Publication Data

US 2013/0270136 A1 Oct. 17, 2013

Related U.S. Application Data

(60) Provisional application No. 61/615,966, filed on Mar. 27, 2012.

(51) Int. Cl.
*B65D 75/28* (2006.01)
*B65D 75/36* (2006.01)
(Continued)

(52) U.S. Cl.
CPC ..... *B65D 75/36* (2013.01); *B65B 5/02* (2013.01); *B65B 9/045* (2013.01); *B65B 47/02* (2013.01);
(Continued)

(58) Field of Classification Search
CPC ..... B25H 3/0003; B65D 5/305; B65B 3/02; B65B 11/52
(Continued)

(56) References Cited

U.S. PATENT DOCUMENTS 2,879,635 A * 3/1959 Brock ..... 53/442
2,931,495 A * 4/1960 Stratton, Jr. ..... 206/471
(Continued)

FOREIGN PATENT DOCUMENTS

CN 1290643 A 4/2001
CN 1777921 A 5/2006
(Continued)

OTHER PUBLICATIONS

International Search Report and Written Opinion in corresponding PCT application (i.e., PCT/US2013/032101), dated Jun. 12, 2013 (11 pages).
(Continued)

*Primary Examiner* — Andrew M Tecco
*Assistant Examiner* — Eyamindae C Jallow
(74) *Attorney, Agent, or Firm* — Maginot Moore & Beck LLP

(57) ABSTRACT

A method of packaging a product includes heating a film of plastic material to a forming temperature until it is thermoformable. At least one of the heated film and at least one product to be packaged are moved in relation to each other until the at least one product deforms the heated film and forms at least one pocket in the heated film that at least partially encapsulates the at least one product. The deformed film with the at least one product at least partially encapsulated in the at least one pocket is then cured.

11 Claims, 5 Drawing Sheets

(51) Int. Cl.

| | |
|---|---|
| ***B65B 5/02*** | (2006.01) |
| ***B65D 8/00*** | (2006.01) |
| ***B65B 9/04*** | (2006.01) |
| ***B65B 47/02*** | (2006.01) |
| ***B65D 75/32*** | (2006.01) |
| ***B65D 65/38*** | (2006.01) |
| ***B65D 79/02*** | (2006.01) |
| ***B65D 85/00*** | (2006.01) |
| *B65B 47/10* | (2006.01) |
| *G08B 13/24* | (2006.01) |
| *B65B 61/06* | (2006.01) |

(52) U.S. Cl.

CPC ..... *B65D 15/00* (2013.01); *B65D 65/38* (2013.01); *B65D 75/326* (2013.01); *B65D 79/02* (2013.01); *B65D 85/70* (2013.01); *B65B 47/10* (2013.01); *B65B 61/06* (2013.01); *B65B 2220/24* (2013.01); *G08B 13/2445* (2013.01)

(58) Field of Classification Search

USPC ..... 206/349, 471; 53/442, 397, 410, 427, 53/432, 433, 444, 453, 456, 461, 464, 53/509, 329.5, 329.3

See application file for complete search history.

(56) References Cited

U.S. PATENT DOCUMENTS

| | | | | | |
|---|---|---|---|---|---|
| 3,226,910 | A | * | 1/1966 | Steffey | 53/397 |
| 3,472,723 | A | * | 10/1969 | Lemelson | 156/500 |
| 3,507,383 | A | * | 4/1970 | Rorer | 206/471 |
| 3,636,678 | A | * | 1/1972 | Maros et al. | 53/412 |
| 3,701,229 | A | * | 10/1972 | Zelnick | 53/427 |
| 3,703,234 | A | * | 11/1972 | Howard | 206/349 |
| 3,785,276 | A | * | 1/1974 | Noor | 99/516 |
| 3,796,306 | A | * | 3/1974 | Swezey | 206/462 |
| 3,848,393 | A | * | 11/1974 | Monoghan | 53/427 |
| 3,910,410 | A | * | 10/1975 | Shaw | 220/359.3 |
| 3,942,829 | A | * | 3/1976 | Humble et al. | 70/57.1 |
| 3,956,867 | A | * | 5/1976 | Utz et al. | 53/433 |
| 4,034,536 | A | * | 7/1977 | Mahaffy et al. | 53/433 |
| 4,069,348 | A | * | 1/1978 | Bush | 426/119 |
| 4,120,984 | A | * | 10/1978 | Richardson et al. | 426/412 |
| 4,229,927 | A | * | 10/1980 | Day | 53/433 |
| 4,537,011 | A | * | 8/1985 | Bortolani et al. | 53/509 |
| 4,642,239 | A | * | 2/1987 | Ferrar et al. | 426/396 |
| 4,958,480 | A | * | 9/1990 | Warner | 53/433 |
| 4,958,731 | A | * | 9/1990 | Calcerano | 206/705 |
| 5,127,974 | A | * | 7/1992 | Tomiyama et al. | 156/85 |
| 5,325,654 | A | * | 7/1994 | Juntunen et al. | 53/440 |
| 5,390,472 | A | * | 2/1995 | Weiler et al. | 53/412 |
| 5,560,490 | A | * | 10/1996 | Chawla | 206/539 |
| 5,937,618 | A | * | 8/1999 | Chandler | 53/427 |
| 6,044,622 | A | * | 4/2000 | Brady et al. | 53/412 |
| 6,378,273 | B1 | * | 4/2002 | Trani et al. | 53/450 |
| 6,449,925 | B1 | * | 9/2002 | Otsu et al. | 53/428 |
| 6,540,073 | B1 | * | 4/2003 | Hagel et al. | 206/379 |
| 6,662,531 | B1 | * | 12/2003 | Schwab et al. | 53/453 |
| 6,843,039 | B1 | * | 1/2005 | Hanmer | 53/427 |
| 7,398,879 | B2 | * | 7/2008 | Nottingham et al. | 206/349 |
| 7,487,625 | B2 | * | 2/2009 | Natterer et al. | 53/433 |
| 7,614,498 | B2 | * | 11/2009 | O'Keefe | 206/459.5 |
| 7,681,732 | B2 | * | 3/2010 | Moehlenbrock et al. | 206/459.1 |
| 8,033,085 | B2 | * | 10/2011 | Martinez Sampedro | 53/511 |
| 8,083,058 | B2 | * | 12/2011 | Marcinkowski et al. | 206/352 |
| 2001/0003114 | A1 | * | 6/2001 | Hansen | 53/427 |
| 2003/0108705 | A1 | * | 6/2003 | Duffield et al. | 428/36.6 |
| 2004/0222113 | A1 | * | 11/2004 | Cullen et al. | 206/349 |
| 2006/0011505 | A1 | * | 1/2006 | Chen | 206/461 |
| 2006/0145869 | A1 | * | 7/2006 | Appalucci et al. | 340/572.8 |
| 2006/0230709 | A1 | * | 10/2006 | Duffield et al. | 53/427 |
| 2006/0232424 | A1 | * | 10/2006 | Duschek | 340/572.8 |
| 2006/0278551 | A1 | * | 12/2006 | Bianchini et al. | 206/463 |
| 2007/0103309 | A1 | * | 5/2007 | Nichols, Sr. | 340/572.8 |
| 2007/0170087 | A1 | * | 7/2007 | Narpes et al. | 206/703 |
| 2007/0290857 | A1 | * | 12/2007 | Li | 340/572.6 |
| 2009/0184019 | A1 | * | 7/2009 | Berbert et al. | 206/497 |
| 2009/0313956 | A1 | * | 12/2009 | Martinez Sampedro | 53/559 |
| 2010/0025278 | A1 | * | 2/2010 | Tilton | 206/459.5 |
| 2010/0115890 | A1 | * | 5/2010 | Granili | 53/427 |
| 2010/0255162 | A1 | * | 10/2010 | Becraft et al. | 426/264 |
| 2010/0301512 | A1 | * | 12/2010 | Rousseau et al. | 264/101 |
| 2010/0314277 | A1 | * | 12/2010 | Murray | 206/461 |
| 2010/0315239 | A1 | * | 12/2010 | Yang | 340/572.9 |
| 2011/0023417 | A1 | * | 2/2011 | Finkowski et al. | 53/443 |
| 2011/0278192 | A1 | * | 11/2011 | Thornton et al. | 206/464 |
| 2011/0290688 | A1 | * | 12/2011 | Marcinkowski et al. | 206/352 |
| 2012/0102897 | A1 | * | 5/2012 | Rousseau et al. | 53/492 |

FOREIGN PATENT DOCUMENTS

| | | | |
|---|---|---|---|
| CN | 201447067 | U | 5/2010 |
| DE | 19928368 | A1 | 12/1999 |
| EP | 0106930 | A1 | 5/1984 |
| EP | 0284529 | A1 | 9/1988 |
| FR | 2729639 | A1 | 7/1996 |
| FR | 2790741 | A1 | 9/2000 |

OTHER PUBLICATIONS

English Translation of Chinese Search Report and Written Opinion corresponding to Chinese Application 2013800222706, dated Nov. 3, 2015 (12 pages).

Chinese Search Report and Written Opinion corresponding to Chinese Application No. 201380022270.6 (6 pages).

* cited by examiner

PACKAGING SYSTEM AND MANUFACTURING THEREOF

TECHNICAL FIELD

The disclosure relates generally to packaging system and manufacturing thereof.

BACKGROUND

Packaging for products can take many forms. One typical type of packaging comprises a display card or panel that is capable of being displayed, e.g., by hanging on a hook on a display rack. The product is held in a molded, clear plastic film that is attached to the panel. The plastic film is typically manufactured using a thermoforming process. Thermoforming is a technique often used to form packaging for products and involves heating a sheet of a thermoplastic material to a forming temperature at which the material becomes pliable. The sheet is then molded to a desired shape and cured so that it retains that shape.

A typical thermoforming process utilizes two complementary shaped molds. The two molds include a positive mold that defines the convex portion of the shape of the film, and a negative mold that defines the concave portion of the shape of the film. With the heated positioned between the molds, the negative mold is pressed into the positive mold, or vice versa, to form the sheet into the shape defined by the molds. The molded sheet is then cured so that it retains the molded shape. Other thermoforming processes utilize vacuum pressure to draw a heated sheet into a mold that has an inner contour with the desired shape.

While such thermoforming processes are effective for packaging products, they require that a separate mold be used to mold the packaging for each product. Creating a separate mold for each product can be expensive. In many cases, a generic mold having a common shape is used for many different products of similar size and shape. As a result, the products are often able to move around within the packaging which can sometimes result in damage to the product and/or the packaging.

DETAILED DESCRIPTION

Figure 1:
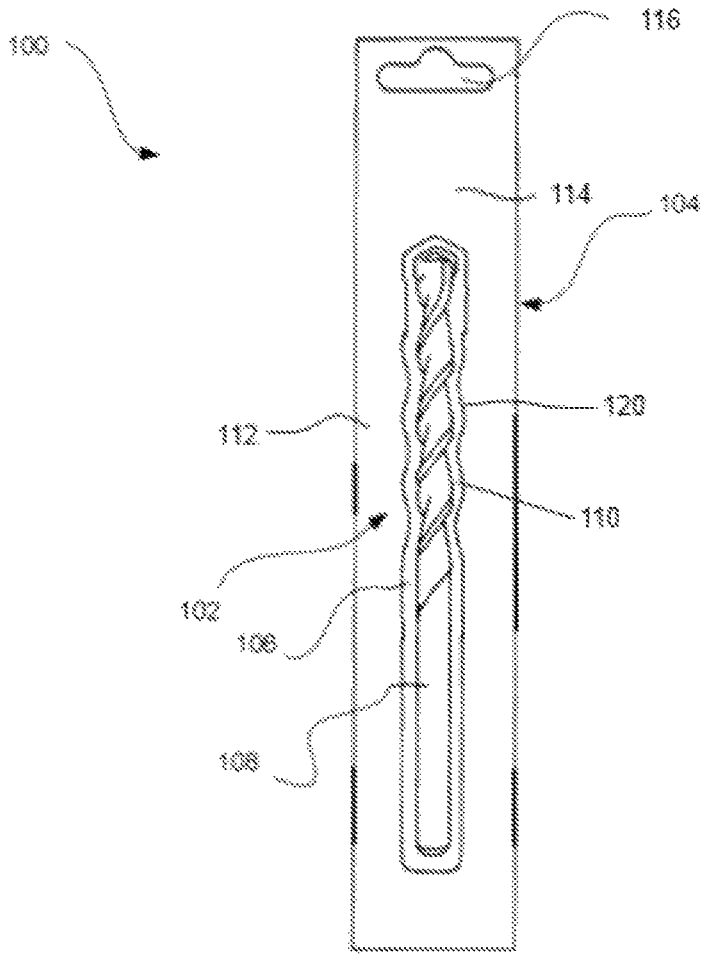
FIG. 1 is a perspective view of a packaging assembly in accordance with an embodiment.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one of ordinary skill in the art to which this disclosure pertains.

The present disclosure is directed to a packaging assembly for a product, such as a tool, accessory tool, part, and the like, and a method of packaging such products. An exemplary embodiment of a packaging assembly 100 in accordance with the present disclosure is depicted in FIG. 1. The packaging assembly includes a first subassembly 102 and a second subassembly 104. The first subassembly 102 includes a film 106 and at least one product 108. As explained below, the film 106 comprises a thermoformed sheet that has been formed to include a container portion 110 and a flange portion 112. The product 108 is received in the container portion 110 of the film 106 and the flange portion 112 is attached to the second subassembly 104.

The film 106 can be a rigid film or a semi-rigid film, and can be clear or transparent, or it can be colored. For example, the film 106 can be polyethylene terephthalate (PET), polypropylene (PP), polyvinyl chloride (PVC), polystyrene (PS), special polyethylene terephthalate (SP ET), alternative polyethylene terephthalate (APET), laminated combination of thermoplastic and non-thermoplastic materials or other known thermoplastic and non-thermoplastic materials. The film 106 can be a single layer structure or a multi-layer structure.

As explained below, the product 108 is used to mold or shape the film 106 during the thermoforming process to form at least one pocket in the film 106 that encapsulates the product 108 and serves as the container portion 110 of the package. Therefore, the container portion 110 closely conforms to the contours and outer shape of the product 108. The exact shape depends on the type of product. In the embodiment of FIG. 1, the product 108 comprises a drill bit. Examples of other products that can be packaged in the packaging assembly using the methods described herein include, but are not limited to, a nut setter, a saw blade, a jig saw blade, a rebar cutter, a hammer steel, a hammer drill bit, a planar blade, a diamond abrasive blade, a screwdriver bit, a router bit, a reciprocating saw blade, a cutting accessory, a scraping or removal accessory, spark plugs, or other known power tool and non-power tool accessories.

The second subassembly 104 includes a support member 114 that provides a structure for attaching the first subassembly 102 and that enables the packaging assembly 100 to be easily transported, stored, and displayed, e.g., by hanging or standing, as a unit. In the embodiment of FIG. 1, the support member 114 comprises a panel having a generally planar configuration. The panel 114 can be a rigid film or a semi-rigid film, and can be clear or transparent, or it can be colored. For example, the panel can be polyethylene terephthalate (PET), polypropylene (PP), polyvinyl chloride (PVC), polystyrene (PS), special polyethylene terephthalate (SPET), alternative polyethylene terephthalate (APET), laminated combination of thermoplastic and non-thermoplastic materials or other known thermoplastic and non-thermoplastic materials. The panel can be a single layer structure or a multi-layer structure. In alternative embodiments, the panel may be formed of other materials, such as cardboard.

The panel 114 is sized and shaped in a manner appropriate for the product 108 contained in the film 106 of the first subassembly 102. The size of the panel 114 is at least sufficient to provide a surface for attaching the flange 112 of the film 106. In alternative embodiments, a support member 114 may be provided in configurations that are not planar, such as a box, cylinder, or other type of three-dimensional shape.

As depicted in FIG. 1, the panel 114 includes a mounting aperture 116 for placing the packaging assembly 100 over an outwardly extending rod or hook (not shown). In alternative embodiments, the panel 114 or other type of support member may be provided with feet or a base (not shown) that enable the packaging assembly 100 to stand up right, e.g., for placement on a display shelf. The panel may also include labels, markings, printed text, pictures, and the like (not shown) for providing information to consumers, such as weight, quantity, measurement, industry standard, logo, warning statement, model, part number, icon, or other known information.

The panel or support member 114 may be provided with an anti-theft device 118 (FIGS. 7-10). The anti-theft device 118 can be a security tag, such as a Sensormatic tag, a near field communication (NFC) tag, a RFID tag, an identification tag, an electronic tag, for example, or other known security device with and without a built-in tracking enabled software. An anti-theft device 118 may be secured to the panel 114 in any suitable manner and at any suitable location on the panel. In one embodiment, the anti-theft device 118 is attached to the panel by a film 120 (FIGS. 7-10) that covers the anti-theft device 118 and is adhered to the panel 114 around the device. The anti-theft device 118 can be left visible on the packaging assembly 100 to provide a visual theft deterrent, or the device 118 can be concealed on or in the packaging assembly to prevent removal.

Figure 2:
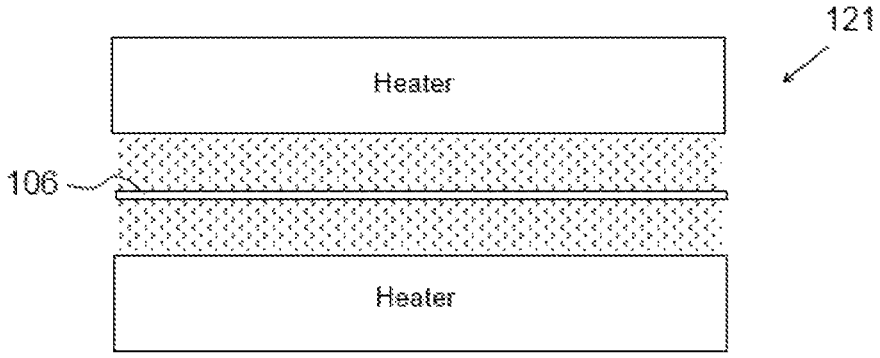
FIG. 2 is a schematic view of a heating station for heating the film of the packaging assembly of FIG. 1.

A schematic depiction of a process of packaging a product to form a packaging assembly 100, such as depicted in FIG. 1, is depicted in FIGS. 2-10. As depicted in FIG. 2, the film 106 for the first subassembly 102 is exposed to a thermoforming temperature at a heating station 121, such as an oven. The forming temperature may be any suitable temperature for the type of material used for the film that is capable of causing the film to become pliable and capable of being stretched and deformed without tearing or breaking and that does not burn or blister the film. The film 106 may be heated from both sides of the film 106 as depicted in FIG. 2 or may be heated from just one side, e.g., the top or the bottom.

Figure 3:
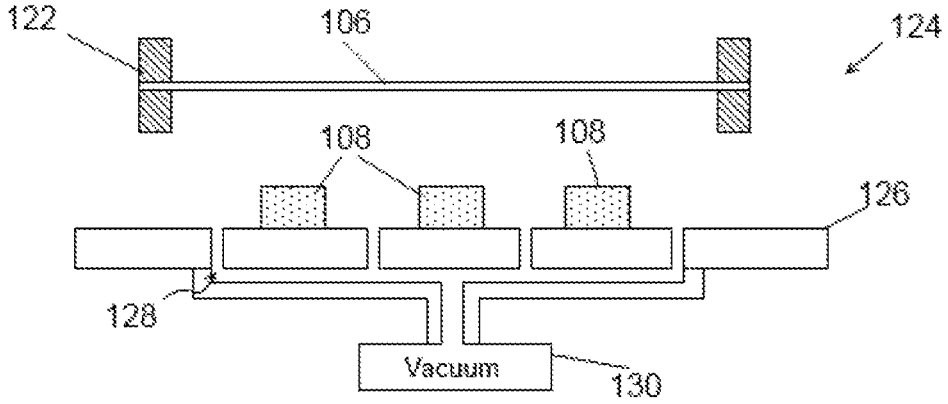
FIG. 3 is a schematic view of a thermoforming station configured to use vacuum pressure to thermoform the film of FIG. 2 using the products to be packaged as molds for the film prior to the heated sheet being thermoformed.

The film 106 is clamped in a film frame assembly 122 at a thermoforming station 124 and stretched over a forming area of the thermoforming station 124 as depicted in FIG. 3. Meanwhile, at least one product 108 is moved into the thermoforming station 124 for engagement with the film 106 as part of the thermoforming process. In this embodiment, three products 108 are depicted as being moved into the thermoforming station. In alternative embodiments, more or fewer products (including a single product) may be used in the thermoforming process at a time.

The products 108 are supported on a fixture 126 in the thermoforming station 124. The products 108 may each be the same product although not necessarily. The fixture 126 may be a component of the thermoforming station 124 or may comprise a portion of a conveyor system, such as a belt that is fed through the station 124. One or the other or both of the film frame assembly 122 and the fixture 126 are configured to move until the film frame assembly 122 contacts the fixture 126 so that the film 106 can be brought into engagement with the products 108. The products 108 on the fixture 126 are used as a mold to shape the film 106 and form a container portion 110 in the film having a form fit that closely surrounds the product and conforms to the outer shape and contours of the product 108.

To thermoform the film 106, some type of pressure is used to cause the film to surround and closely conform to the products. In one embodiment, the thermoforming station 124 is configured to utilize vacuum pressure to cause the film 106 to be drawn around each product 108 on the fixture 126. Vacuum pressure may be generated in any suitable manner. As an example, the film frame assembly 122 may be configured to form an air tight seal with the fixture 126. The fixture 126 is provided with openings 128 that enable air to be drawn out of the vacuum chamber by a vacuum generator 130. As the air is drawn out of the vacuum chamber, the film 106 is drawn down toward the fixture 126 until the film 106 surrounds and closely conforms to the shape of the products 108.

Figure 4:
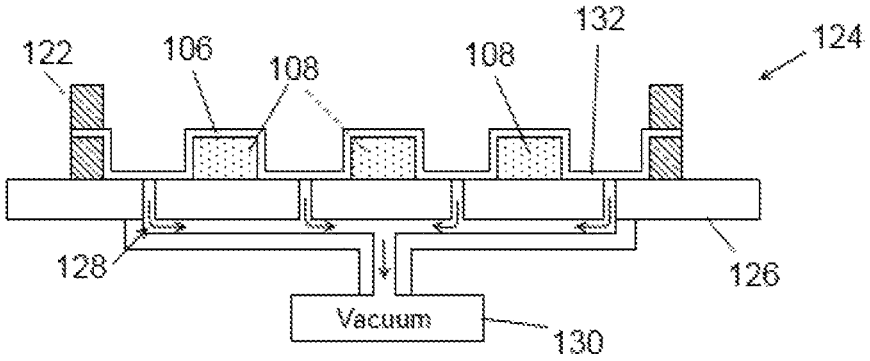
FIG. 4 is a schematic view of the thermoforming station of FIG. 2 after vacuum pressure has been used to draw the heated film down over the products.

The portion of the film 106 surrounding the products 108 corresponds to the container portion 110 of the film. As can be seen in FIG. 4, the portions 132 of the film 106 between (and around) the products 108 lie flat against the fixture 126. These portions 132 correspond to the flanges 112 of the film 106 that are used to attach the film 106 to the panels 114, either singularly or plurality. As an alternative to vacuum pressure, the thermoforming station may be configured to utilize other means of thermoforming the film using the products as the mold. For example, the thermoforming station may be configured to use pressure thermoforming or mechanical thermoforming techniques. In addition, the positions of the film and the product may be changed so that the product is supported above the film and the film is drawn up around the products.

After the film 106 has been shaped, the film 106 is allowed to cure around the products so that the film 106 can retain the thermoformed shape. The film 106 may be cured in place in the thermoforming station 124 or may be transported to a curing station (not shown) for curing. The film 106 may be cured in any suitable manner appropriate for the materials used. Examples of types of curing that may be used include radiant heating, cooling, forced air, microwave dryers and combinations of these types.

Figure 5:
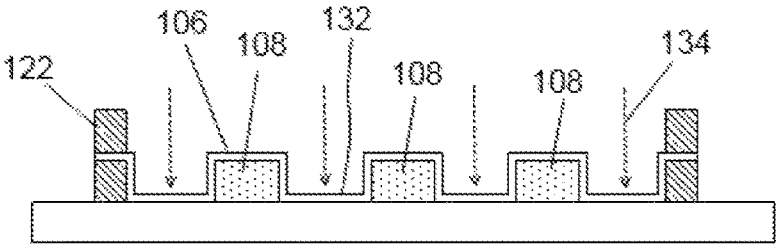
FIG. 5 is a schematic view of the thermoformed film and products of FIG. 4 being singulated to form first packaging subassemblies.
Figure 6:
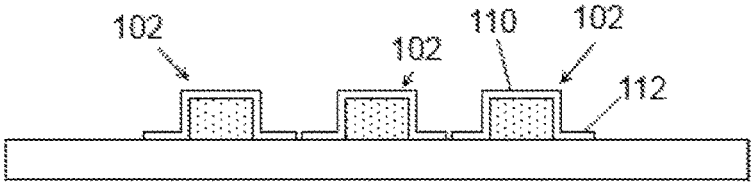
FIG. 6 is a schematic view of the singulated first package subassemblies of FIG. 5.

Before or after the film 106 has been cured, the thermoformed film 106 may be singulated to separate the products 108 into individual subassemblies. The film 106 may be singulated in any suitable manner. As depicted in FIG. 5, the film 106 may be singulated along die cutting lines 134 between each product 108 using a die cutting machine (Not shown). Other suitable methods of die cutting process are sufficed such as using a saw, a laser, a strip knife blade, water jet, ultrasonic, or other known singulating process. As depicted in FIG. 6, a plurality of first packaging subassemblies 102 are formed after the film 106 is singulated. Each packaging subassembly 102 may include a single product 108 or multiple products (not shown). The first packaging subassemblies 102 may then be attached to a second packaging subassembly 104, either singularly or plurally. In alternative embodiments, the packaging subassemblies 102, 104 may be attached to each other before singulating.

Figure 7:
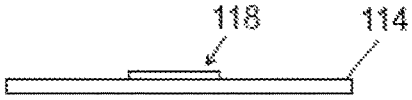
FIG. 7 is a schematic view of the panel of the packaging assembly of FIG. 1 with an anti-theft device attached thereto.
Figure 8:
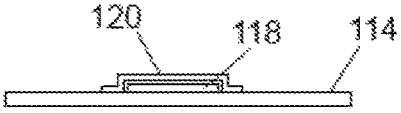
FIG. 8 is a schematic view of the panel of FIG. 7 with a film attached over the anti-theft device to form a second packaging subassembly.

As depicted in FIG. 7, the panel 114 of the second subassembly 104 may be provided with an anti-theft device 118 which can be attached to the packaging assembly during or after the assembly of the film to the panel. The anti-theft device 118 may be attached to a surface of the panel 114, e.g., using adhesive or bonding. To protect the anti-theft device, a covering 120, such as a film, is placed over the anti-theft device 118 and attached to the panel 114 around the anti-theft device. To encapsulate the anti-theft device 112, the film 120 may undergo a process to seal the circumferential surfaces of the film 120 and the panel 114 together and minimize the likelihood of neutralizing the anti-theft device 118. The film 120 may comprise a rigid plastic that is opaque or clear that is sufficiently sized to cover the anti-theft device and be attached to the panel. In alternative embodiments, other types of coverings for the anti-theft device may be used.

Figure 9:
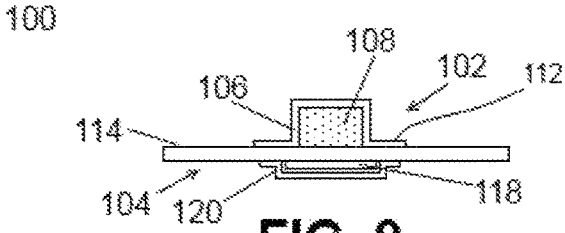
FIG. 9 is a schematic view of one of the singulated first packaging subassemblies of FIG. 6 attached to the second packaging subassembly of FIG. 8 to form a packaging assembly, such as depicted in FIG. 1.

The first packaging subassemblies 102 may be attached to the second packaging subassemblies 104 before or after an anti-theft device 118 has been attached to the panel 114. As shown in FIG. 9, the flange 112 of the film 106 of a first subassembly 102 is placed against a surface of the panel 114 of the second subassembly 104 and sealed to the panel, e.g., by adhesive. Any suitable adhesive or may be used depending upon the materials used for tray and film. Alternatively, some type of heat and/or pressure type seal may be used to seal the flange of the film to the panel.

Figure 10:
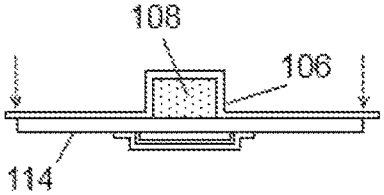
FIG. 10 depicts a packaging assembly, such as depicted in FIG. 9, with a film that overlaps the panel.

In some cases, the film and/or the panel may be have to be resized in which case a trimming operation may be performed to trim the film 106 and/or the panel 114 to the appropriate size using any known technique as depicted in FIG. 10. Mounting apertures, labels, stickers, text/image printing, and the like that are incorporated into the packaging assembly may be performed at any suitable time during the process.

Figure 11:
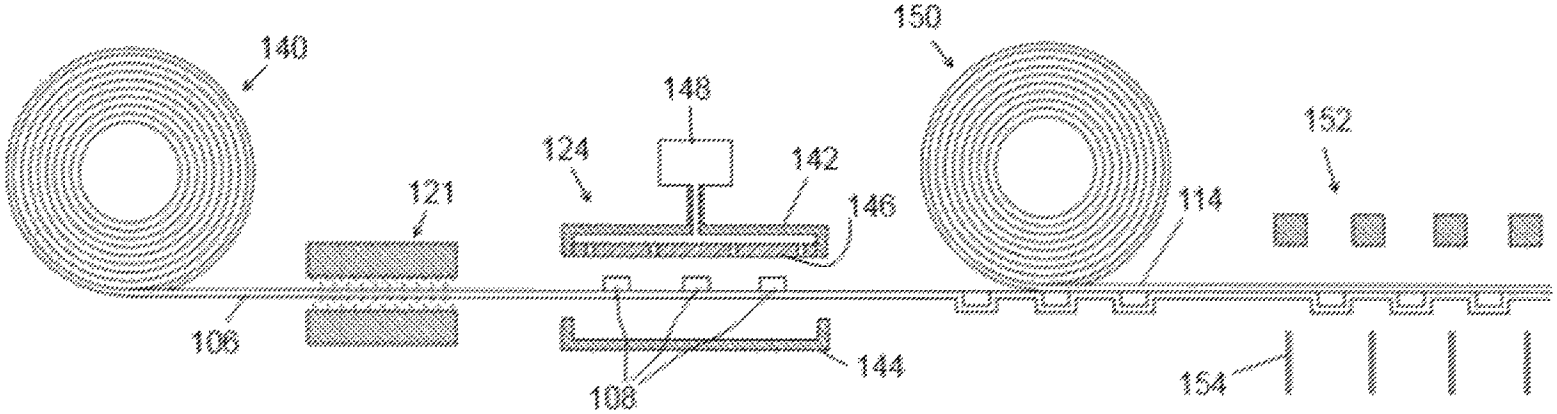
FIG. 11 is a schematic view of another embodiment of a thermoforming packaging process in which the product to be packaged is used as the mold for the packaging film.
Figure 12:
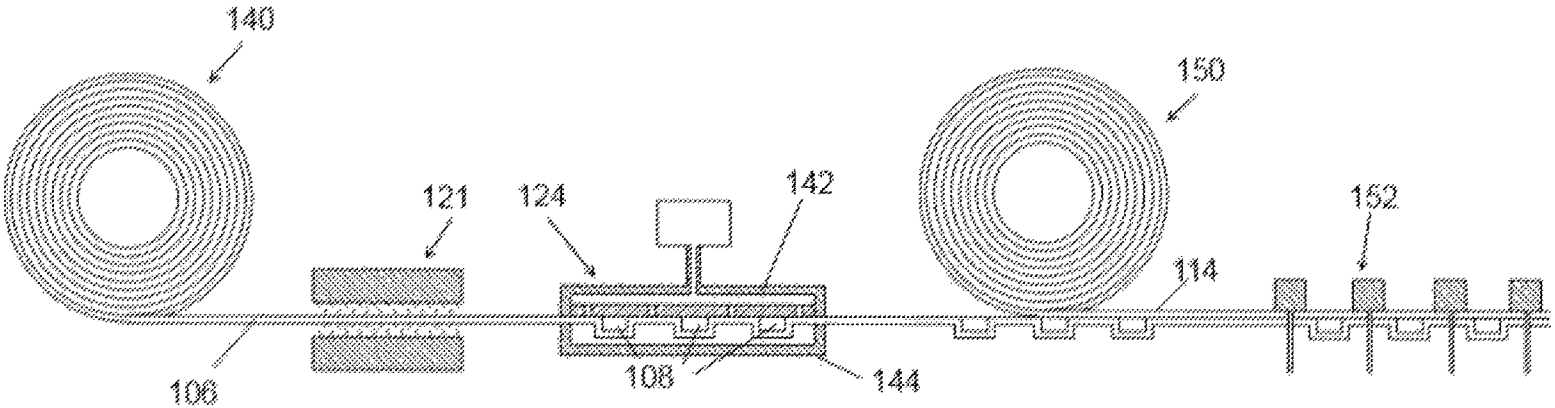
FIG. 12 is another schematic view of the packaging process of FIG. 11.

FIGS. 11 and 12 depict schematically another version of the packaging process. In this embodiment, the film 106 for the first packaging assembly 102 is supplied as a continuous web from a supply roll 140. The film 106 is fed through a heating station 121 where it is heated to a thermoforming temperature. The film then passes through a thermoforming station 124. In the thermoforming station 124, the products 108 are positioned above the film 106. An upper fixture member 142 and a lower fixture member 144 are configured to come together to form an air-tight thermoforming enclosure around the products 108 and the film 106. The upper fixture member 142 is configured similar to the fixture 126 described above including a flat pressing portion 146 that faces toward the products 108 and a vacuum source 148 behind the pressing portion 146 for drawing the film 106 toward the products 108.

In this embodiment, the panels 114 for the packaging assemblies are incorporated into the process and fed over the thermoformed film and products after they leave the thermoforming station 124. The panel material is supplied as a continuous web from a supply roll 150 although in alternative embodiments panels may be supplied as single pieces. The panel material from the roll 150 is pressed onto and attached to the flanges 112 of the thermoformed film 106 prior to reaching a singulating station 152. At the singulating station 152, the thermoformed film 106 with the products 108 contained therein and the paneling 114 attached thereto is divided, e.g., by die cutting using a die cutting machine 154, into individual packing assemblies 100.

Figure 13:
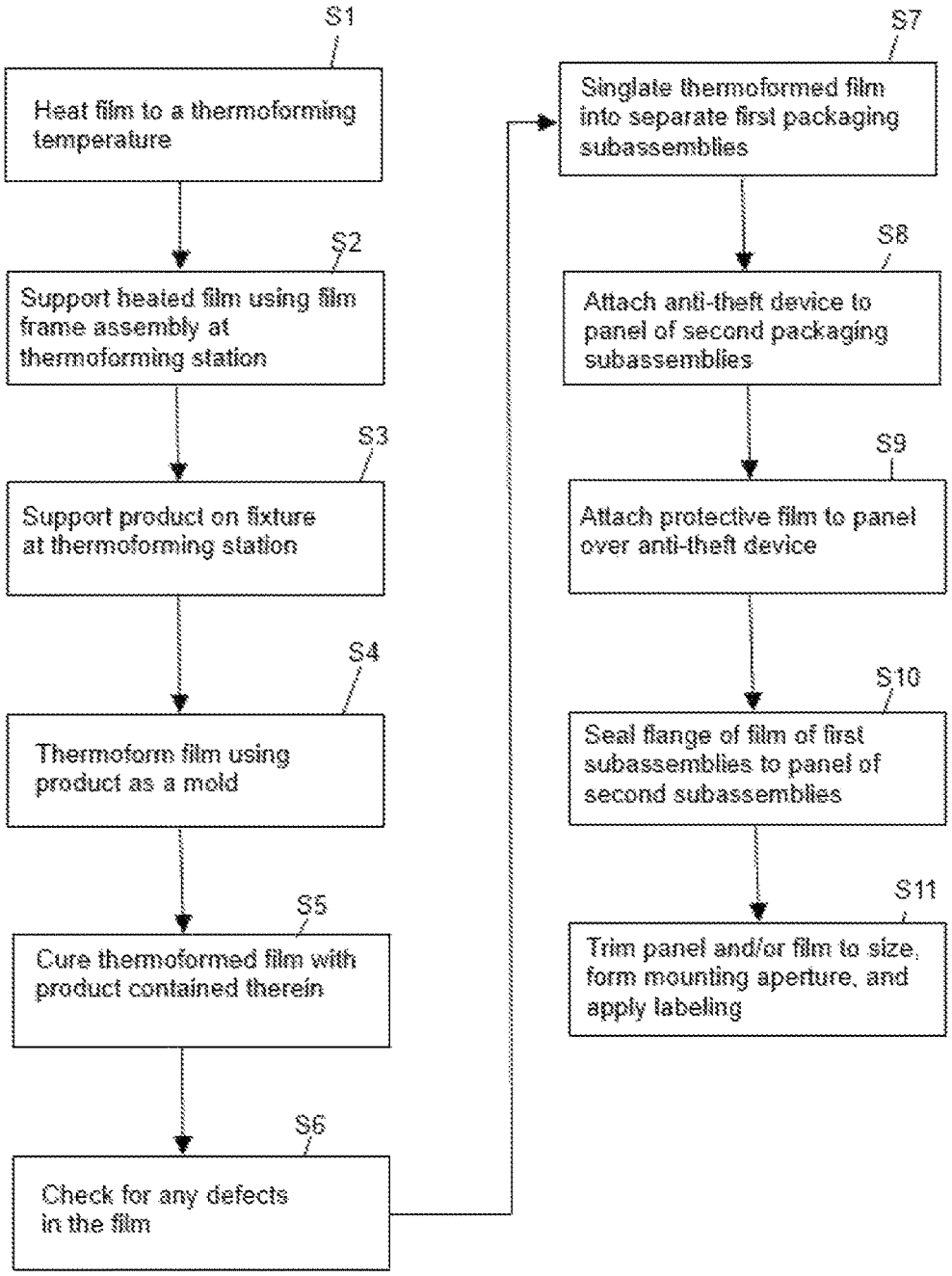
FIG. 13 is a flowchart describing an embodiment of a method for a packaging assembly.

FIG. 13 depicts a flowchart detailing the process steps of an exemplary method of packaging a plurality of products according to the disclosure. At S1, a film 106 for a packaging assembly 100 is heated to a thermoforming temperature at a thermoforming station 124. A film frame assembly 122 is provided to hold the film 106 at a thermoforming station at S2, and a plurality of product 108 is placed and properly aligned on a fixture 126 at the thermoforming station at S3. The film 106 and the products are then moved into engagement with each other at the forming station such that the film 106 is deformed by the product at S4 until the film partially surrounds the product and takes on a thermoformed shape that conforms to a shape of the product. The film 106 is then cured with the film surrounding the portion of the product at S5.

The first assembly 102 is then checked for any misalignment, the degree of film grip to the product 108, and other known quality defects at S6. At S7, the thermoformed film and product is die cut or singulated into a plurality of first packaging subassemblies 102. To encapsulate the sub-packaging devices 120, a panel 110 is provided. An optional anti-theft device 112 may be adhesively attached or bonded to a surface of the panel 110 by any known attachments at S8. An opaque rigid film of plastic 124 is placed over the anti-theft device 112 to cover the anti-theft device 112 and seal the film 124 to the panel 110 without neutralize the anti-theft device during the sealing process S9.

At S10, the first packaging subassemblies 102 are placed on the panels 114 of the second packaging subassemblies 104, and the flange of the films of the first packaging subassemblies 102 is sealed to the panels 114. Any excess of the film 106 and/or the panel 110 is sized and trimmed by any known techniques, mounting apertures formed, and labeling provided at S11.

The above described packaging systems and methods can save time and reduce costs in the packaging process as a separate mold does not have to be formed for each product and separate steps do not have to be performed to create the mold, then fill the molds with the products. In addition, numerous modifications of the above-described processes and systems are possible and fall within the scope of the present disclosure. For example, although many of the steps describe above were described as being performed separately or at separate stations, a person of ordinary skill in the art would understand that certain steps may be combined or performed simultaneously.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A method of packaging a product comprising:

heating a first film of plastic material to a forming temperature at a thermoforming station until it is thermoformable;

positioning a plurality of products to be packaged in the thermoforming station along with the heated first film;

moving at least one of the heated first film and the plurality of products to be packaged in relation to each other until the plurality of products deforms the heated first film and forms a plurality of pockets in the heated first film, each of the pockets at least partially encapsulating at least one of the products in the plurality;

forming flange portions in the heated first film around each of the pockets;

curing the deformed first film with the plurality of products at least partially encapsulated in the pockets in the first film;

attaching security tags to a first side of a packaging panel;

covering the security tags with a second plastic film, the second film being placed over each of the security tags and attached to the first side of the packaging panel around each of the security tags;

securing the flange portions of the first film to a second side of the packaging panel; and singulating the cured first film and the packaging panel to form a plurality of packaging assemblies, each of the packaging assemblies including a portion of the first film and a portion of the packaging panel, the portion of the first film having a pocket in which at least one of the products is retained and a flange which surrounds the pocket, the flange being secured to the portion of the packaging panel, the portion of the packaging panel of each of the packaging assemblies including one of the security tags covered by the second film.

2. The method of claim 1, wherein the heated first film is deformed until the heated film contacts a planar support member to form the flange portions that surround each pocket.

3. The method of claim 1, wherein securing the flange portions to the packaging panel includes sealing the flange portions to the packaging panel.

4. The method of claim 1, wherein the singulating includes die cutting the first film and the packaging panel into the plurality of packaging assemblies using a die-cutting machine.

5. The method of claim 1, further comprising:

trimming excess material from the packaging assemblies.

6. The method of claim 1, further comprising:

forming mounting apertures in the packaging assemblies.

7. The method of claim 1, wherein the product comprises a tool product.

8. The method of claim 7, wherein the tool product comprises an accessory tool or tool bit.

9. The method of claim 1, wherein the first film of plastic material is supplied from a roll as a continuous web that is guided through the thermoforming station, wherein the plurality of products are positioned above the first film in the thermoforming station, wherein the thermoforming station includes a pressing portion that presses the plurality of products into the first film from above, such that the pockets formed in the first film by the products extend below the first film, and wherein the first film is drawn upward into contact with the pressing portion to form the flange portions around the products.

10. The method of claim 9, further comprising:

guiding the continuous web from the thermoforming station to a singulating station where the packaging assemblies are singulated with the products retained in the pockets.

11. The method of claim 10, wherein the packaging panel is supplied from a roll and fed over the continuous web between the thermoforming station and the singulating station such that the packaging panel is attached to the flange portions prior to reaching the singulating station.

* * * * *